US008840794B2

(12) United States Patent
Danov et al.

(10) Patent No.: US 8,840,794 B2
(45) Date of Patent: Sep. 23, 2014

(54) DEVICE FOR SEPARATING FERROMAGNETIC PARTICLES FROM A SUSPENSION

(75) Inventors: Vladimir Danov, Erlangen (DE); Werner Hartmann, Weisendorf (DE)

(73) Assignee: Siemens Aktiengesellschaft, Munich (DE)

( * ) Notice: Subject to any disclaimer, the term of this patent is extended or adjusted under 35 U.S.C. 154(b) by 393 days.

(21) Appl. No.: 13/119,518

(22) PCT Filed: Jul. 21, 2009

(86) PCT No.: PCT/EP2009/059377
§ 371 (c)(1),
(2), (4) Date: Mar. 17, 2011

(87) PCT Pub. No.: WO2010/031617
PCT Pub. Date: Mar. 25, 2010

(65) Prior Publication Data

US 2011/0168618 A1 Jul. 14, 2011

(30) Foreign Application Priority Data

Sep. 18, 2008 (DE) ..... 10 2008 047 851

(51) Int. Cl.
*B03C 1/02* (2006.01)
*B03C 1/18* (2006.01)

(52) U.S. Cl.
CPC .... *B03C 1/18* (2013.01); *B03C 1/02* (2013.01)
USPC ..... 210/695; 210/222; 209/218; 209/232

(58) Field of Classification Search
CPC ..... B03C 1/00; B03C 1/02; B03C 1/18; B01D 35/06
USPC ..... 210/222, 223, 396, 400, 695; 209/218, 209/232
See application file for complete search history.

(56) References Cited

U.S. PATENT DOCUMENTS

| | | | | |
|---|---|---|---|---|
| 3,428,179 | A | 2/1969 | Boyd et al. | 210/222 |
| 4,921,597 | A | 5/1990 | Lurie | 209/223.2 |
| 4,961,841 | A | 10/1990 | Andres et al. | 209/1 |
| 2002/0084225 | A1 | 7/2002 | Hatch et al. | 210/695 |
| 2003/0159942 | A1 | 8/2003 | Minevski et al. | 205/477 |

(Continued)

FOREIGN PATENT DOCUMENTS

| | | | | |
|---|---|---|---|---|
| CN | 2302060 | Y | 12/1998 | B03C 1/18 |
| CN | 2382474 | Y | 6/2000 | B03C 1/18 |

(Continued)

OTHER PUBLICATIONS

International Preliminary Report on Patentability for PCT/EP2009/059377, Mar. 22, 2011.*

(Continued)

*Primary Examiner* — David A Reifsnyder
(74) *Attorney, Agent, or Firm* — King & Spalding L.L.P.

(57) ABSTRACT

A device for separating ferromagnetic particles from a suspension has a tubular reactor and a plurality of magnets which are arranged outside the reactor, the magnets (9) being movable along at least a part of the length of the reactor (2) up to the vicinity of a particle extractor (5) by means of a rotary conveyor (8).

20 Claims, 4 Drawing Sheets

(56) References Cited

U.S. PATENT DOCUMENTS

| | | | | |
|---|---|---|---|---|
| 2005/0178701 | A1 | 8/2005 | Roth et al. | 209/636 |
| 2005/0266394 | A1 | 12/2005 | Hatton et al. | 435/4 |
| 2007/0056912 | A1 | 3/2007 | Oder et al. | 210/695 |

FOREIGN PATENT DOCUMENTS

| | | | | |
|---|---|---|---|---|
| CN | 201070600 | Y | 6/2008 | B03C 1/02 |
| DE | 2651137 | A | 5/1977 | B03C 1/10 |
| DE | 2916634 | A1 | 11/1980 | B03C 1/025 |
| DE | 3744167 | A1 | 7/1989 | B03C 1/029 |
| DE | 8915615 | U1 | 11/1990 | B03C 5/00 |
| DE | 9309075 | U1 | 8/1993 | B03C 1/22 |
| DE | 20108093 | U1 | 8/2001 | B03C 1/06 |
| DE | 102008047851 | A1 | 4/2010 | B03C 1/00 |
| DE | 271116 | A | 3/2014 | |
| EP | 1000663 | A1 | 5/2000 | B03C 1/12 |
| FR | 2887471 | A1 | 12/2006 | B03C 1/32 |
| GB | 520626 | A | 4/1940 | |
| WO | 0207889 | A2 | 1/2002 | |
| WO | 2005105314 | A1 | 11/2005 | B03C 1/32 |

OTHER PUBLICATIONS

International PCT Search Report and Written Opinion, PCT/EP2009/059377, 13 pages.

International Preliminary Report on Patentability, PCT/EP2009/061612, 10 pages.

* cited by examiner

DEVICE FOR SEPARATING FERROMAGNETIC PARTICLES FROM A SUSPENSION

CROSS-REFERENCE TO RELATED APPLICATIONS

This application is a U.S. National Stage Application of International Application No. PCT/EP2009/059377 filed Jul. 21, 2009, which designates the United States of America, and claims priority to DE Application No. 10 2008 047 851.2 filed Sep. 18, 2008. The contents of which are hereby incorporated by reference in their entirety.

TECHNICAL FIELD

The invention relates to a device for separating ferromagnetic particles from a suspension, comprising a tubular reactor and a plurality of magnets arranged outside this reactor.

BACKGROUND

It is known to use magnetic separation in order to extract ferromagnetic components from a starting material. To this end one or more magnets are provided, which generate a magnetic field that interacts with the ferromagnetic particles contained in the starting material and attract them, so that separation is possible in principle. An example of the use of such magnetic separation is the recovery of ferromagnetic $Fe_3O_4$ particles from a suspension, as is encountered for example in the scope of extracting $Cu_2S$ particles from ground ore. In this case, the ore as a raw material is initially ground finely; besides other substantial components (sand etc.) it also contains $Cu_2S$ in a small amount. In order to separate this nonmagnetic material, the ground ore powder is processed with a carrier liquid to form a suspension, $Fe_3O_4$ (magnetite) being added to this suspension together with one or more chemical agents which ensure hydrophobizing by organic molecule chains that accumulate both on the $Cu_2S$ particles and on the $Fe_3O_4$ particles. By means of these organic molecule chains, agglomeration then takes place in which $Fe_3O_4$ particles accumulate on one or more $Cu_2S$ particles, and thus substantially encapsulate them. By means of magnetic separation, it is then possible to extract these larger multicomponent agglomerates.

All magnetizable substances suitable for this purpose will be referred to below generically as "$Fe_3O_4$", this also being intended to include all other ferrites, oxides and metal compounds and alloys which are sufficiently chemically inert. Likewise, the term "$Cu_2S$" stands generically for all valuable ores extracted in mining, and therefore also covers pure noble metals and compounds thereof, as well as all sulfidic, oxidic and other metal compounds.

This separation process is subsequently followed by another possible magnetic separation process, since it is subsequently necessary to separate these agglomerates that have been formed, which were merely formed to permit magnetic separation of the nonmagnetic $Cu_2S$, since on the one hand the $Fe_3O_4$ needs to be recovered and on the other hand the purpose of the processing is to extract the $Cu_2S$. To this end, by means of various techniques, the organic compounds inside the agglomerates, by means of which the $Cu_2S$ particles and the $Fe_3O_4$ particles are connected to one another, are broken up so that the suspension contains the separate dissolved particles, from which in turn the $Fe_3O_4$ particles can be subsequently separated by means of a magnetic separating device and subsequently reused, while the nonmagnetic $Cu_2S$ particles remain in the suspension and can subsequently be separated from it.

To date, it has been conventional to use a tubular reactor for the separation, through which the material to be magnetically treated flows. One or more magnets are arranged locally fixed on the outer wall of the reactor, these attract the ferromagnetic material contained, and the material migrates to the reactor wall and is held by the neighboring magnet. Although this allows effective separation, it only permits a batch separation process since after a sufficient amount of agglomerate has accumulated, the suspension has to be taken from the reactor and only then can the ferromagnetic agglomerates, which have thus far been fixed on the wall by means of the magnets, be extracted. A new separation cycle can then be started.

SUMMARY

According to various embodiments, a device for a continuous separation of ferromagnetic agglomerates and/or particles, that is to say magnetic material, in particular from a product of magnetic ore separation or water cleaning or the like, wherever the suspension is produced can be provided.

According to an embodiment, a device for separating ferromagnetic particles from a suspension, may comprise a tubular reactor and a plurality of magnets arranged outside the reactor, wherein the magnets can be moved along at least a part of the length of the reactor as far as the vicinity of a particle extractor by means of a revolving feed device.

According to a further embodiment, the feed device can be a conveyor belt or a conveyor chain. According to a further embodiment, the magnets can be moved along a path extending obliquely with respect to the longitudinal axis of the reactor with increasing proximity to the reactor in or opposite to the longitudinal feed direction. According to a further embodiment, the magnets may have a shape adapted to the outer contour of the reactor on the side facing toward the reactor. According to a further embodiment, two or more rows of magnets can be provided, which preferably lie opposite one another and can be moved by means of separate feed devices. According to a further embodiment, a common control device can be provided for controlling the feed operation so that the magnets, lying in a common plane, of the plurality of feed devices are moved together while preserving their arrangement. According to a further embodiment, two mutually opposite rows of magnets can be provided, each of which has a semicircular lateral surface shape so that two neighboring magnets combine to form a circular shape. According to a further embodiment, the magnets can be arranged in a Halbach arrangement in the region of the reactor. According to a further embodiment, the magnets can be arranged only on one side of the reactor. According to a further embodiment, a baffle, which removes the magnetically separated particles from the rest of the suspension, or a pump extractor can be provided in the region of the particle extractor.

BRIEF DESCRIPTION OF THE DRAWINGS

Other advantages, features and details will be explained with the aid of the exemplary embodiments described below and with reference to the figures, in which.

DETAILED DESCRIPTION

Figure 1:
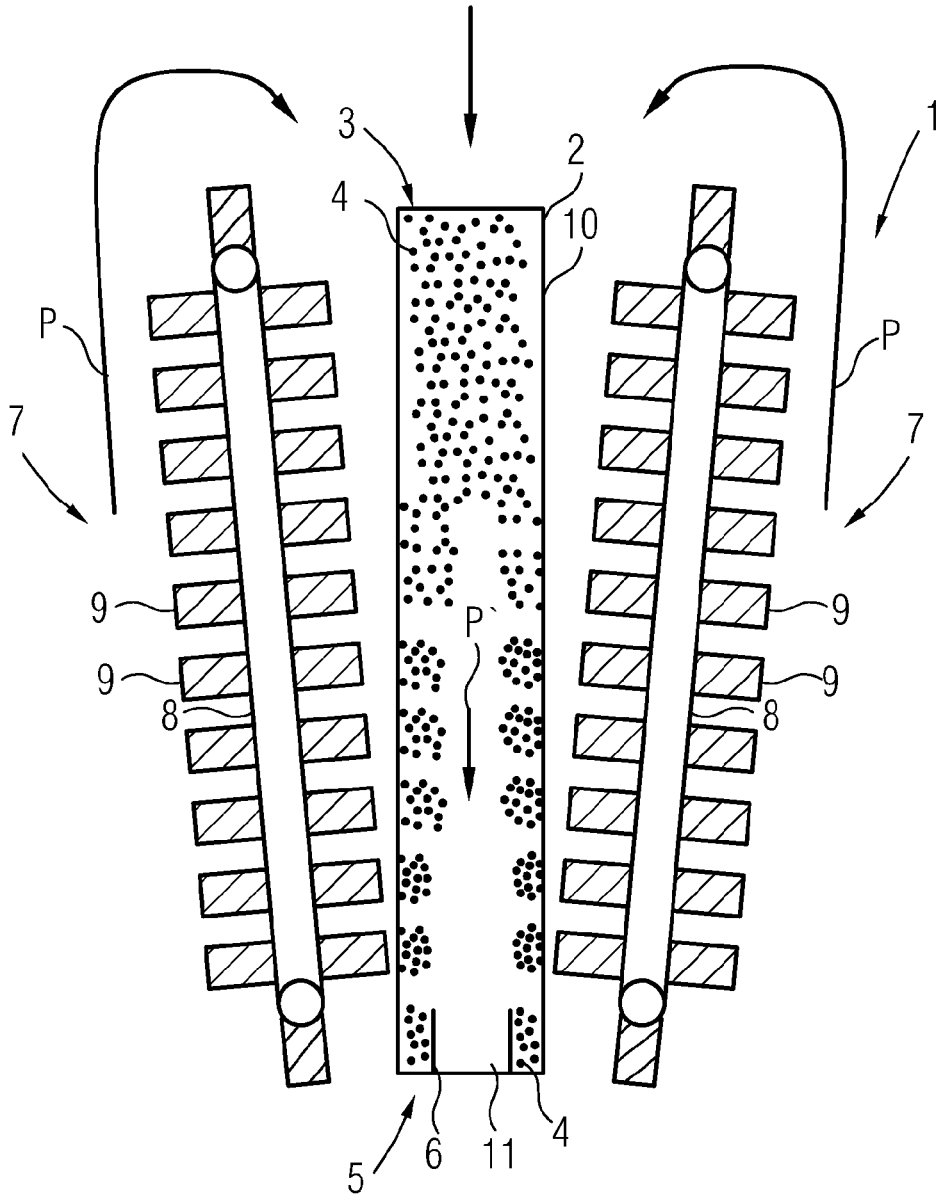
FIG. 1 shows an outline diagram of a device in a first embodiment.

According to various embodiments, in a device of the type mentioned in the introduction, the magnets can be moved along at least a part of the length of the reactor as far as the vicinity of a particle extractor by means of a revolving feed device. In what follows, the term particle extractor will also be used synonymously for the region where magnetizable agglomerates are extracted.

The various embodiments propose a mobile arrangement of the magnets provided next to the outside of the reactor. The magnets are moved along the outer wall of the reactor by means of a revolving feed device, the movement path extending over at least a part of the length of the reactor, and optionally over virtually the entire length of the reactor. In any event, this magnet movement path extends as far as the vicinity of a particle extractor on the reactor. The travelling magnets generate a travelling magnetic field, which moves along the longitudinal axis of the reactor. In this way, it is possible for ferromagnetic material concentrated over the length of the reactor to be fed actively along the reactor to the particle extractor. The magnet feed path ends in the region of the particle extractor, that is to say the magnets are removed from their proximity to the reactor there by means of the revolving feed device, so that the magnetic field generated there by the respective magnet is weakened to such an extent that the ferromagnetic particles hitherto fixed by it are released and can be extracted through the particle extractor, this extraction usually taking place by means of the flow of the carrier fluid of the suspension, that is to say the particles are so to speak flushed away but are separated from the other components which are contained in the remaining suspension. As an alternative the flushing flow may be controlled, and in particular also increased, by additional pumping at the particle extractor.

The movement of the particles proposed according to various embodiments, and the resulting generation of a travelling magnetic field moved along the longitudinal axis of the reactor, particularly advantageously allows continuous throughput. This is because by means of this travelling field, it is possible on the one hand to carry out separation of the ferromagnetic agglomerates over the length of the reactor, and on the other hand active transport of the ferromagnetic agglomerates as far as the particle extractor is possible, unlike in the case of previously known techniques in which the ferromagnetic agglomerates and/or particles adhere locally to the wall and cannot be transported actively to the particle extractor. As a result of this, with the device according to various embodiments, continuous processing of the suspension is possible since the separation process does not have to be interrupted in order to extract the ferromagnetic particles, as in the prior art.

The feed device is expediently a conveyor belt or a conveyor chain, on which the magnets are fastened by means of suitable receptacles or holders. The conveyor belt or conveyor chain revolves through 360°, so as to ensure continuous magnet movement.

Although it is in principle possible to convey the magnets parallel to the longitudinal axis of the reactor, that is to say parallel or equidistantly next to the outside of the tube, it is also conceivable to move the magnets, at least in the entry section where they are thus conveyed to the reactor for the first time by the feed device, along a path extending obliquely with respect to the longitudinal axis of the reactor with increasing proximity to the reactor in the longitudinal feed direction. This means in effect that the magnet movement path extends obliquely with respect to the longitudinal axis of the reactor, or the outer side of the reactor, and the magnets move ever closer to the reactor wall or further away from it over the feed length. This means that the distance of the magnets from the reactor varies over the feed path. This is advantageous when it is desired to bring the ferromagnetic material to be separated, i.e. for example $Fe_3O_4$ particles, first close to the wall, which is possible by means of the somewhat weaker fields in the entry region owing to the large distance, and only then is it intended to carry out the actual transport directly along the wall, in order to avoid possible fixing of the material on the reactor wall ("caking").

For field generation over as large an area as possible, that is to say in order to attract the ferromagnetic material to the reactor wall over as large an area as possible, it is expedient for the magnets to have a shape adapted to the outer contour of the reactor on the side facing toward the reactor. The magnet surface is therefore curved in a way corresponding to the shape of a cylindrical tube, so as to provide as large as possible a field-generating area which is equidistant from the reactor wall virtually everywhere. In principle, it is conceivable to make the magnets so large that they effectively have a semicircular shape, that is to say to configure them for example as semicircular segment-polarized magnets. In the case of tubes with a rectangular cross section it is possible to use cuboid magnets which are particularly simple to produce.

Although in principle it is possible to provide only one row of magnets, and thus only one feed device having a plurality of magnets, it is of course conceivable to provide two or more rows of magnets, which preferably lie opposite one another and can be moved by means of separate feed devices. For example, two feed devices may be used which are offset from one another by 180°. The poling of the respective magnets of the feed devices is to be selected so as to obtain optimal field formation inside the reactor, which makes it possible to act as intensively and effectively as possible on the ferromagnetic particles in order to attract them to the reactor wall. In this context, it is of course also conceivable to provide four such feed devices, for example, which are then offset by 90° each. The magnets may in principle be shaped in a way corresponding to the outer shape of the reactor, so that effectively the magnets, lying respectively in a plane, of the plurality of feed devices combine substantially annularly to give vertically moved "magnetic rings" formed from the individual magnets. In order to permit this, a common control device is advantageously provided for controlling the feed operation of the plurality of feed devices so that the magnets, lying in a common plane, of the plurality of feed devices are moved together while preserving their arrangement relative to one another, i.e. while preserving the plane and therefore the "ring shape".

Expediently, however, preferably two mutually opposite rows of magnets are provided, each of which has a semicircular lateral surface shape so that two neighboring magnets, i.e. magnets lying in a plane, combine to form a circular shape. This means that the two semicircular, segment-polarized and mutually opposite magnets of the two feed devices form a combined magnet arrangement, which extends except for a short distance around almost the entire circumference of the reactor, so that the field can be coupled in over virtually the entire outer surface of the reactor and the separation can take place over the entire circumference. In this case, the particle extractor is preferably formed as an annular gap (in the case of cylindrical tubes).

In principle, it is possible to arrange the magnets successively and at a distance from one another on the conveyor belt or conveyor chain, so that each magnet forms its own separate magnetic field. As an alternative to this, the magnets may be arranged in a Halbach arrangement on the feed device. In this configuration, two magnets with a different polarization direction are respectively arranged neighboring and separated from one another on the conveyor belt or conveyor chain, a further magnet closing the magnetic circuit substantially in the form of a yoke being arranged between them, the polarization direction of which magnet is selected so as to provide magnetic closure. The magnetic field is then formed between the two magnets which neighbor one another but are polarized oppositely to one another. The coupling between these two magnets via the closure magnet arranged between them in the manner of a yoke is not rigid, that is to say these magnets are not rigidly connected to one another, which is necessary in order to make it possible to open or break the magnetic field in the region where the magnets are deflected, close to the particle extractor. The use of such a feed device having a Halbach magnet arrangement is advantageous in so far as magnetic closure of the field lines takes place, i.e. it is configured so that magnetic fields occur only on one side of the arrangement while the other side is almost field-free, which is to say that such a feed device needs to be arranged effectively on only one side of the reactor. In this way, the magnetic field strength is increased and the fields are concentrated periodically onto the regions of the magnets polarized perpendicularly to the reactor arrangement, so as to provide a periodic magnetic field along the longitudinal axis.

Lastly, a baffle, which removes the magnetically separated particles or agglomerates from the rest of the suspension, or a pump extractor which allows reliable extraction of the separated particles, may be provided in the region of the particle extractor. When using cylindrical arrangements, the separating baffle is formed as the tube end, that is to say likewise with cylindrical symmetry.

FIG. 1 shows a device 1 according to various embodiments comprising a tubular reactor 2, to which a suspension 3 consisting of a carrier fluid and particles contained in it is delivered continuously by means of a supply (not shown in detail). As shown here, these particles also include ferromagnetic particles 4, for example $Fe_3O_4$ particles. At the lower end of the reactor 2 there is a particle extractor 5, to which an annular baffle 6 is assigned. In this region, the ferromagnetic particles 4 to be separated are finally removed from the rest of the suspension 3.

In order to make it possible to separate the ferromagnetic agglomerates or particles 4, two magnetic separating devices 7 are provided in the example shown, each of which comprises a feed device 8 for example in the form of a conveyor belt or conveyor chain, on which feed device 8 a multiplicity of individual magnets 9 are arranged. The feed device 8 revolves through 360°, so that continuous movement of the magnets 9 along the feed path is possible.

The separating devices 7 are arranged in such a way that they extend along the reactor 2, so that the feed path, along which the magnets 9 are moved next to the outer wall 10 of the reactor, extends over the essential part of the reactor length. The feed directions are respectively indicated by arrows P, that is to say in this case with a vertically standing reactor the magnets are moved onto the reactor wall at the upper end of the separating device 7 and are moved downward along the reactor outer wall 10. As can be seen, the separating devices 7 are slightly tilted with respect to the reactor 2, that is to say the distance of the magnets 9 in the upper reactor region is greater than in the lower reactor region. The effect of this is that the material to be separated, here i.e. the ferromagnetic particles 4, are initially only moved in the direction of the reactor wall in the upper region without directly bearing on the wall, since the fields there are somewhat weaker owing to the larger distance of the magnets. Only when the magnets are close enough to the reactor wall are the fields strong enough for the ferromagnetic particles 4 to be attracted directly onto the reactor wall. The spaced arrangement of the magnets 9 effectively gives rise to local magnetic fields which are also moved vertically downward owing to the vertical movement of the magnets 9, that is to say travelling magnetic fields are effectively generated, by means of which the ferromagnetic particles 4 are actively moved downward as represented by the two arrows P'. As can be seen, with an increasing movement distance in the direction of the particle extractor 5, the particles 4 are moved ever closer to the reactor wall until they lie almost entirely on the reactor wall; there are no longer any ferromagnetic particles in the middle of the reactor, where there are only carrier liquid and any other nonferromagnetic particles, contained in the suspension 3. Depending on the physical properties of the suspension to be separated, the inclination of the magnet arrangement relative to the reactor 10 may also be reversed, that is to say with the shortest distance in the upper region and the longest distance in the extractor region. The direction of the slope depends in particular on the viscosity of the suspension 3, the concentration of the solids content and the maximum permissible magnetic particle concentration for an optimal separation result.

At the lower end of the feed devices 8, the magnets 9 are moved away from the outer wall of the reactor 10 again owing to the deflection, that is to say the magnetic field decreases very greatly.

Consequently, the ferromagnetic particles 4 hitherto attracted thereby are released. Since they are already in immediate proximity to the particle extractor 5, they are advantageously extracted by means of the continued flow of the suspension, by entering the region which is formed between the annular baffle 6 and the reactor wall, while the rest of the suspension is extracted in the region of the central extractor 11.

As can be seen, continuous application is possible here since separation of the ferromagnetic particles taking place continuously over the reactor length is possible.

Figure 2:
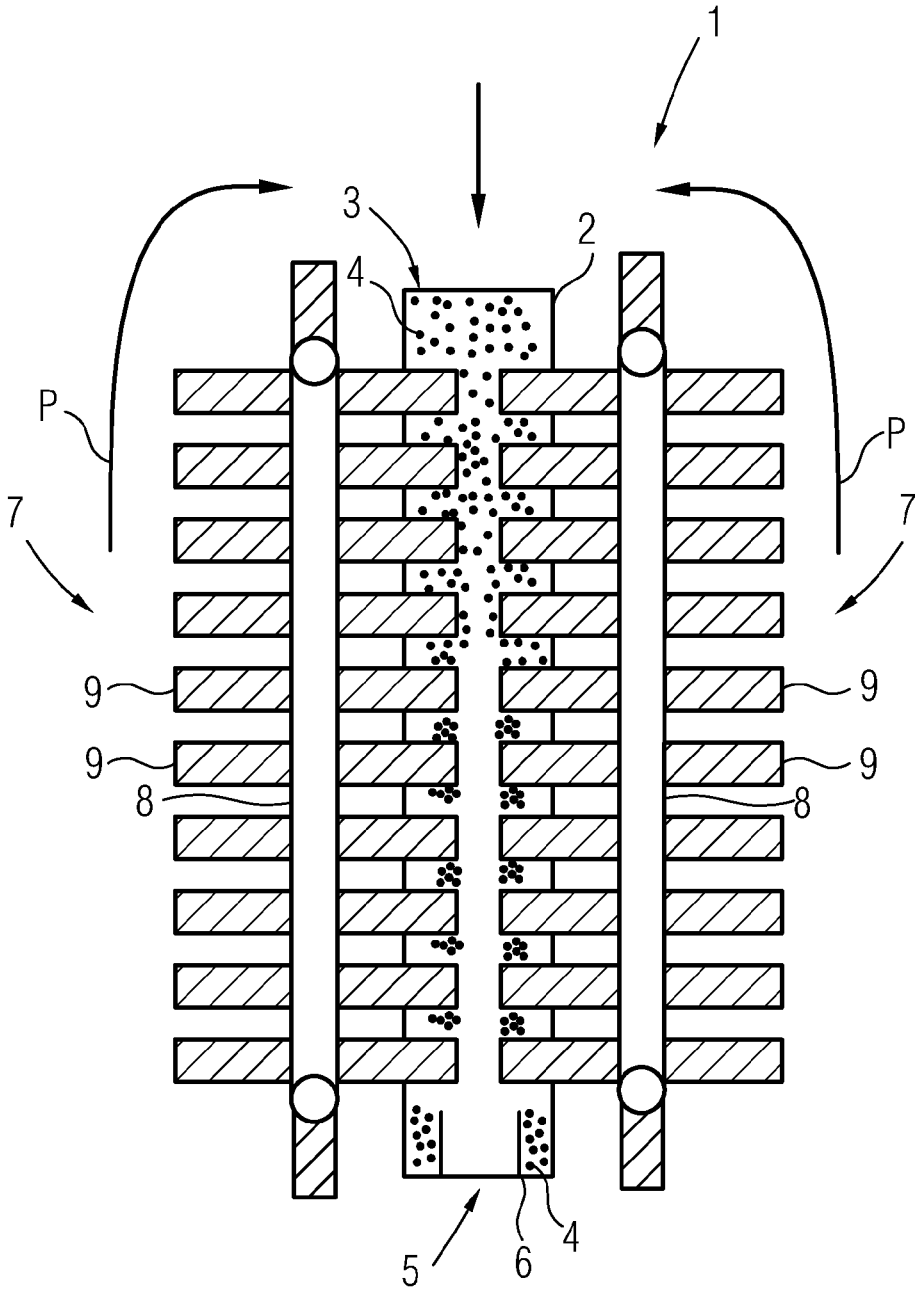
FIG. 2 shows an outline diagram of a device in a second embodiment.

FIG. 2 shows another embodiment of a device 1; where the same parts are provided, the same references are used. Here again, a reactor 2 is provided into which a suspension 3 containing ferromagnetic particles 4 is introduced. At the lower end, there is again a particle extractor 5 having a baffle 6 in order to extract the ferromagnetic particles 4 which have been separated.

Two magnetic separating devices 7 are likewise provided, which are provided mutually opposite on the two sides of the reactor 2, each feed device 8 comprising for example a conveyor belt or conveyor chain, which are driven in revolving fashion through 360° by means of suitable drive motors, as well as magnets 9 arranged thereon.

Figure 3:
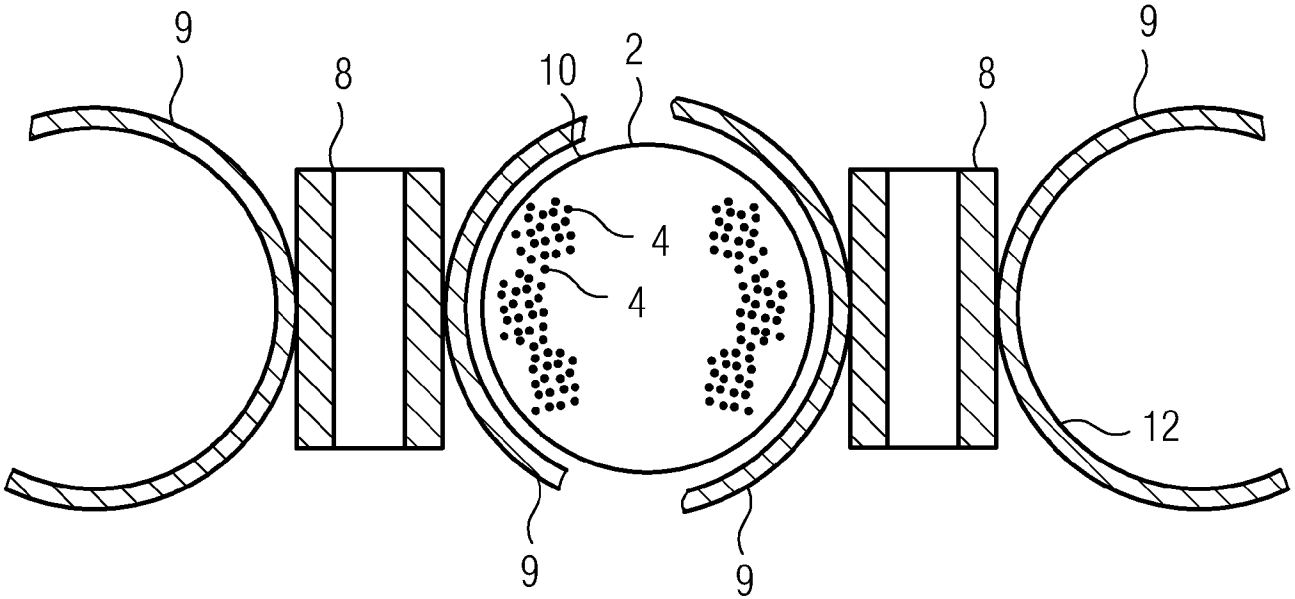
FIG. 3 shows an enlarged partial sectional view of the device in FIG. 2.

As can be seen from the sectional representation according to FIG. 3, the magnets 9 are configured here as semicircular segment-polarized magnets which are fixed by means of suitable holders (not shown in detail here) on the feed device 8, i.e. for example the conveyor belt. The magnets 9 shown next to the reactor 2 bear around the outer wall of the reactor 10 over a large surface, that is to say they substantially form a magnetic ring which engages over the entire circumference of the reactor 2. This is possible since the inner surfaces 12 of the magnets 9 are configured in a semicircular fashion.

This configuration makes it possible to carry out the magnetic separation substantially around the entire circumference of the reactor 2, and not just locally as is the case in the configuration according to FIG. 1.

It should be pointed out here that the separating devices 7 may of course also be arranged extending obliquely with respect to the longitudinal axis of the reactor in the device according to FIG. 2, and naturally the separating devices 7 may also operate parallel to the longitudinal axis of the reactor as in the configuration according to FIG. 1.

Figure 4:
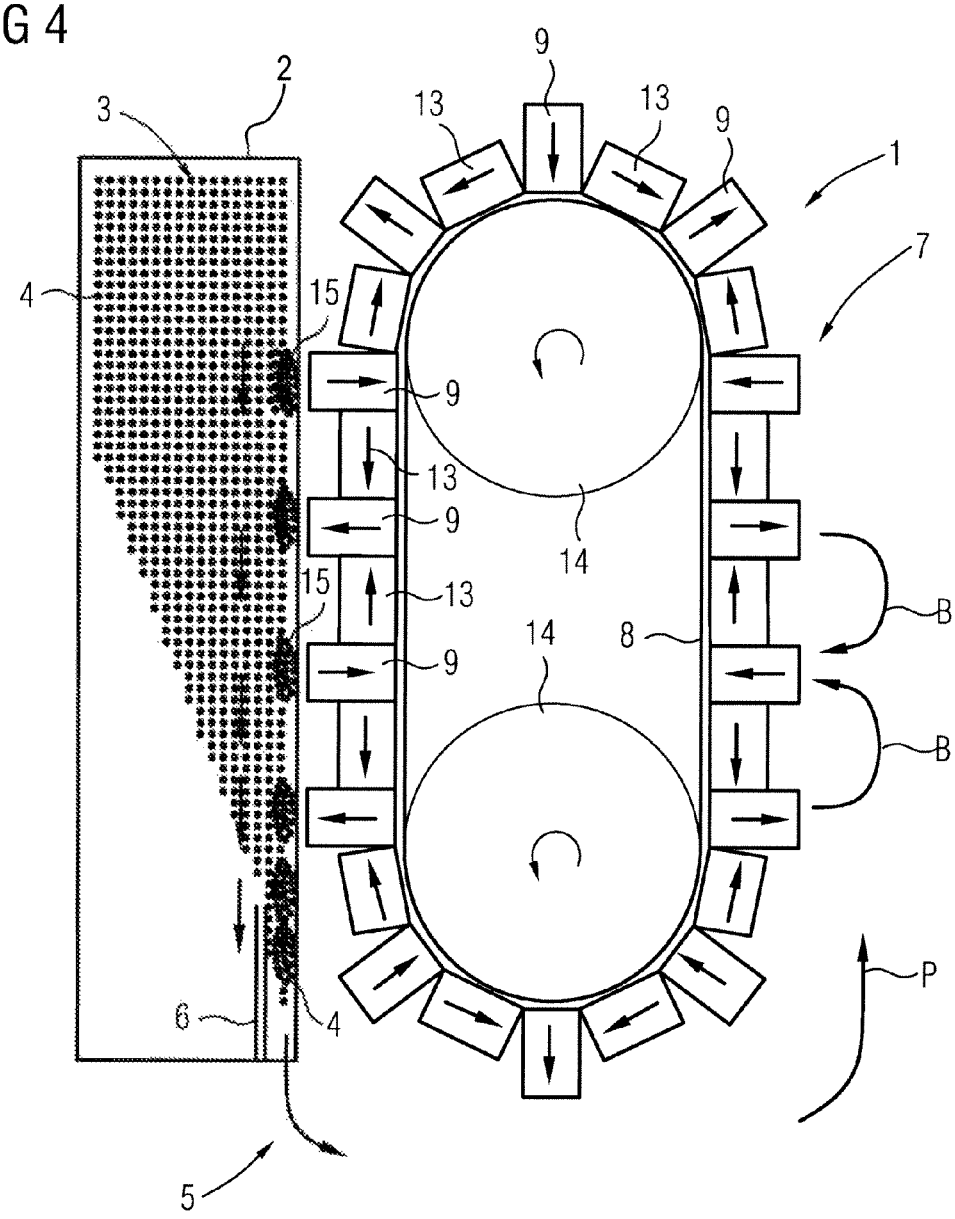
FIG. 4 shows a device in a third embodiment, having magnets in a Halbach arrangement.

FIG. 4 lastly shows a third embodiment of a device 1, in which case the same references are also used for elements which are the same. A reactor 2 is again provided, to which a suspension 3, which contains inter alia ferromagnetic particles 4, is delivered continuously. This reactor also has a particle extractor 5 with a baffle 6, although the latter is only formed here as a partially circumferential wall or the like, owing to the working principle of this device 1.

A magnetic separating device 7 is again provided, comprising a feed device 8 in the form of a conveyor belt or conveyor chain on which magnets 9 protruding therefrom are provided. These magnets 9 are respectively aligned alternately from one another in terms of their magnetic polarization, which is represented by means of the arrows indicated in the magnets 9, that is to say the polarizations of two neighboring magnets 9 are respectively directed oppositely. Between each pair of such magnets 9, further magnets 13 acting as yokes are placed, the magnetic polarization of which is such that the field carried by a respective pair of neighboring magnets 9 and the magnet 13 placed between them is closed between the two magnets 9 as indicated by the arrows P in FIG. 4. The arrangement of the magnets 9 and 13 is such that they are not firmly connected to one another but, see the upper and lower ends of the separating device 7, are separated from one another during deflection when they hence run onto the deflection rollers 14. The effect achieved by this is that the magnetic field B respectively formed between two neighboring magnets 9 is attenuated or broken owing to the opening of the coupling via the magnets 13. The magnet arrangement shown here is referred to as a Halbach arrangement.

The result of this arrangement is that the magnetic field strength is increased owing to the magnetic closure of the field lines, and the fields are concentrated onto the regions of the magnets 9 so as to provide a periodic magnetic field along the longitudinal axis of the reactor 2. Here again, the continuous movement of the magnets 9 and 13 along the reactor 2 leads to the formation of a periodic travelling magnetic field. At the end, that is to say in the region of the lower deflection taking place in the region of the particle extractor 5, where the output of the ferromagnetic particles 4 takes place, the Halbach arrangement is opened by tilting away the respectively last magnet 9 or 13 so that the magnetic field is attenuated there and the magnetized particle concentrate held fixed by the magnetic field is released. This is diverted from the liquid flow without further measures, for example via the outflow channel which is formed, through which a forced flow is optionally generated by pumping, and/or by the baffle 6 which divides the liquid flows.

Since the separating device 7 is arranged on only one side here, the particles 4 clearly only migrate to this side, as shown in FIG. 4. There is a strong particle concentration in the wall region and in the region of the individual magnets 9, where as mentioned this field enhancement takes place owing to the Halbach arrangement, as represented by the regions 15 which have their concentration increased.

What is claimed is:

1. A device for separating ferromagnetic particles from a suspension, comprising:

a tubular reactor having a length;

a particle extractor disposed adjacent one end of the tubular reactor;

a magnetic separation device including an elongated revolving feed device and a plurality of magnets moved in a continuous loop by the elongated revolving feed device;

wherein the magnetic separation device, including the revolving feed device and plurality of magnets, is arranged fully outside the tubular reactor; and wherein the revolving feed device is configured to move the magnets in a feed direction along at least a part of the length of the tubular reactor toward the particle extractor, thereby attracting the ferromagnetic particles (a) toward the particle extractor and (b) toward locations radially outward from a central axis of the tubular reactor; and at least one structure at or proximate the particle extractor for extracting the ferromagnetic particles from the radially outward locations.

2. The device according to claim 1, wherein the revolving feed device is a conveyor belt or a conveyor chain.

3. The device according to claim 1, wherein the revolving feed device is configured such that a path of the magnets along the at least part of the length of the tubular reactor extends obliquely with respect to the central axis of the reactor with increasing proximity to the tubular reactor in the feed direction of the revolving feed device.

4. The device according to claim 1, wherein each of the plurality of magnets has a shape adapted to an outer contour of the tubular reactor.

5. The device according to claim 1, wherein the plurality of magnets include two or more rows of magnets are provided, which lie opposite one another and further comprising a separate revolving feed device for each of the two or more rows of magnets.

6. The device according to claim 5, further comprising a common control device for controlling a feed operation so that the plurality of magnets are moved simultaneously, preserving their disposition relative to one another.

7. The device according to claim 1, wherein the plurality of magnets comprise two mutually opposite rows of magnets, and wherein each magnet of the plurality of magnets has a semicircular lateral surface shape so that two neighboring magnets combine to form a circular shape.

8. The device according to claim 1, wherein the plurality of magnets are arranged in a Halbach arrangement.

9. The device according to claim 8, wherein the plurality of magnets are arranged only on one side of the tubular reactor.

10. The device according to claim 1, wherein the particle extractor comprises a baffle, or a pump extractor.

11. A method for separating ferromagnetic particles from a suspension, comprising the steps of:

arranging a magnetic separation device adjacent and fully outside a tubular reactor having a length, the magnetic separation device including an elongated revolving feed device configured to move a plurality of magnets in a continuous loop fully outside the tubular reactor, passing the suspension along the length of the tubular reactor toward a particle extraction end, and operating the revolving feed device to move the magnets in a feed direction along at least a part of the length of the tubular reactor toward a particle extractor, thereby attracting the ferromagnetic particles (a) toward the particle extractor and (b) toward locations radially outward from a central axis of the tubular reactor, and at the particle extraction end of the tubular reactor, removing the ferromagnetic particles from the radially outward locations.

12. The method according to claim 11, wherein the revolving feed device comprises a conveyor belt or a conveyor chain.

13. The method according to claim 11, wherein a path of the magnets along the at least part of the length of the tubular reactor extends obliquely with respect to the central axis of the tubular reactor with increasing proximity to the tubular reactor in the feed direction of the revolving feed device.

14. The method according to claim 11, wherein the plurality of magnets each have a shape adapted to an outer contour of the tubular reactor.

15. The method according to claim 11, wherein the plurality of magnets are disposed in two or more rows which lie opposite one another and are moved by means of separate feed devices.

16. The method according to claim 15, further comprising the step of controlling the movement of the revolving feed device so that the two or more rows of magnets move simultaneously while preserving their relative physical disposition.

17. The method according to claim 11, wherein the plurality of magnets are disposed in two mutually opposite rows, each magnet having a semicircular lateral surface shape so that two neighboring magnets combine to form a circular shape.

18. The method according to claim 11, wherein the plurality of magnets are disposed in a Halbach arrangement.

19. The method according to claim 18, wherein the plurality of magnets are disposed only on one side of the tubular reactor.

20. The method according to claim 11, wherein a baffle removes the magnetically separated particles from the rest of the suspension.

* * * * *